United States Patent [19]

McLeod

[11] 4,149,713

[45] Apr. 17, 1979

[54] WEIGHT LIFTING DEVICE FOR THE LOWER EXTREMITIES

[76] Inventor: Ruffin C. McLeod, 3680 Ruefort #205, Flint, Mich. 48504

[21] Appl. No.: 804,703

[22] Filed: Jun. 8, 1977

[51] Int. Cl.[2] ..... A63B 21/06

[52] U.S. Cl. ..... 272/117; 272/130; 272/144; 272/143; 272/134; 128/25 R

[58] Field of Search ..... 272/117, 119, 130, 134, 272/144, 146, DIG. 4, 96, 127, 97, 900; 128/25 R

[56] References Cited

U.S. PATENT DOCUMENTS

| | | | |
|---|---|---|---|
| 2,408,597 | 10/1946 | Belling | 272/127 |
| 2,455,274 | 11/1948 | Scriver | 272/97 |
| 2,689,127 | 9/1954 | Silverton et al. | 272/134 X |
| 3,112,108 | 11/1963 | Hanke | 272/117 X |
| 3,892,404 | 7/1975 | Martucci | 272/134 |

*Primary Examiner*—Richard C. Pinkham
*Assistant Examiner*—William R. Browne
*Attorney, Agent, or Firm*—Basile and Weintraub

[57] ABSTRACT

An exercise and rehabilitation device for strengthening the knee, ankle and leg of the user employes a table having a horizontally translatable chair mounted thereon, an arcuate track substantially perpendicular to the path of travel of the chair and a system of weights interconnected to a boot mounted for lateral and rotational motion in the track.

12 Claims, 12 Drawing Figures

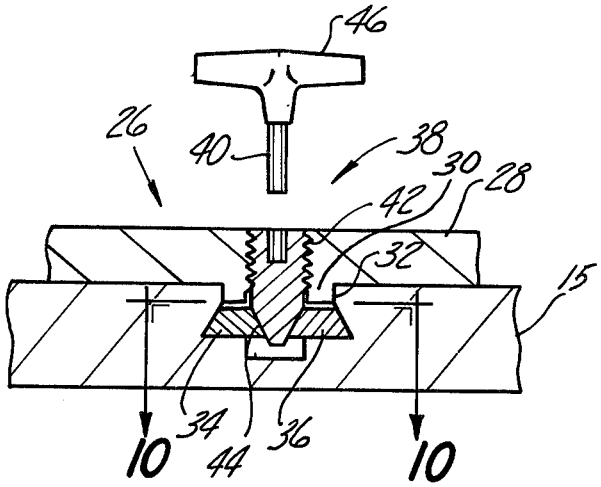
Fig-9
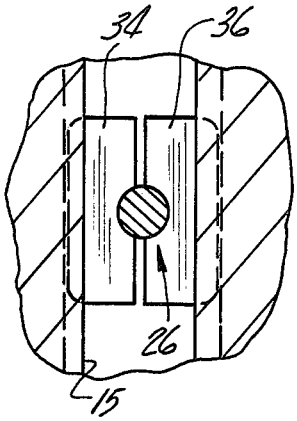
Fig-10
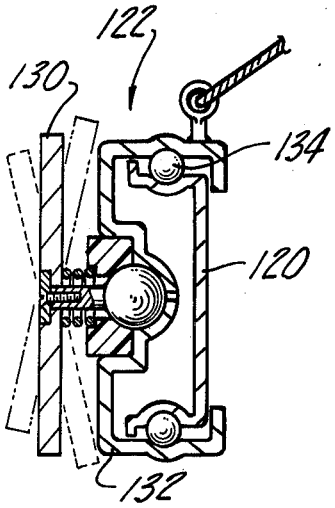
Fig-11
Fig-12
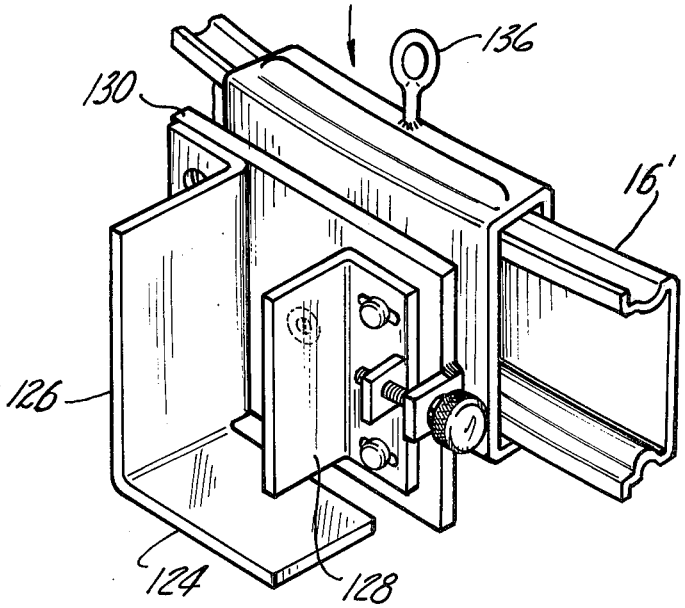

WEIGHT LIFTING DEVICE FOR THE LOWER EXTREMITIES

BACKGROUND OF THE INVENTION

1. Field of the Invention

The present invention pertains to exercise devices. More particularly, the present invention pertains to exercise devices for the knee and ankle. Even more particularly, the present invention pertains to knee and ankle exercise devices which employ weight systems to import strength to the knee and ankle.

2. Prior Art

In both organized and unorganized athletics, sports and recreational activities, injuries to the knee and ankle are the most common of all injuries. Whether such injury is due to an accident or whether it is due to structural limitations, i.e. insufficient strength of the injured joint, the injury can usually be avoided if proper precautions are taken. Such proper precautions contemplate the strengthening of the knee and ankle joints.

Conventional sports and athletic training devices now in use have limited applications in the area of strength development and support of the injury prone areas under consideration herein. Present devices are predicated on a single strengthening maneuver which improves flexion and extension of the knee and ankle joint. However, this totally avoids the fact that injuries occurring to these joints arise with the adduction, abduction, rotation and pronation of the lateral areas of the knee or joint. Such prior art devices are exemplified in U.S. Pat. Nos. 3,734,495; 3,116,062; and 48,051. Other art representative of exercise devices of previous design includes U.S. Pat. Nos. 3,749,400; 1,121,795; 2,362,111; 499,205; 2,855,199 and 2,632,645.

It is to be appreciated from the preceding that a major advance would be provided by a device which strengthens the knee and ankle joints in not only the extension and flexion areas, but the lateral areas, as well.

SUMMARY OF THE INVENTION

In accordance with the present invention, there is provided an exercise and rehabilitative device particularly adapted for strengthening the knee and ankle joint of the joint of the user. The device hereof comprises:

(a) a table, (b) a horizontally and vertically translatable chair mounted on the table, (c) a track mounted to the table substantially perpendicular to the path of travel of the chair, (d) a foot-engageable boot mounted onto the track, the boot being laterally and rotationally mounted onto the track, and (e) a system of weights interconnected to the boot.

In a preferred embodiment of the present invention, the exercise device has a pair of opposed chairs and a pair of tracks. One track is particularly adapted for strengthening the knee and the other track for strengthening the ankle and the rotational muscles. This enables the device to be used by two persons at any one time.

For a more complete understanding of the present invention, reference is made to the following detailed description and accompanying drawing. In the drawing like reference characters refer to like parts throughout the several views in which:

BRIEF DESCRIPTION OF THE DRAWING

FIG. 9 is a sectional view of a chair of the present invention taken along line 9—9 of FIG. 1;

FIG. 10 is a cross-sectional view taken along line 10—10 of FIG. 9;

FIG. 11 is a cross-sectional view taken along line 11—11 of FIG. 1, and FIG. 12 is a perspective view of the foot-engaging boot utilized for ankle strengthening in the practice of the present invention.

DESCRIPTION OF THE PREFERRED EMBODIMENT

Figure 1:
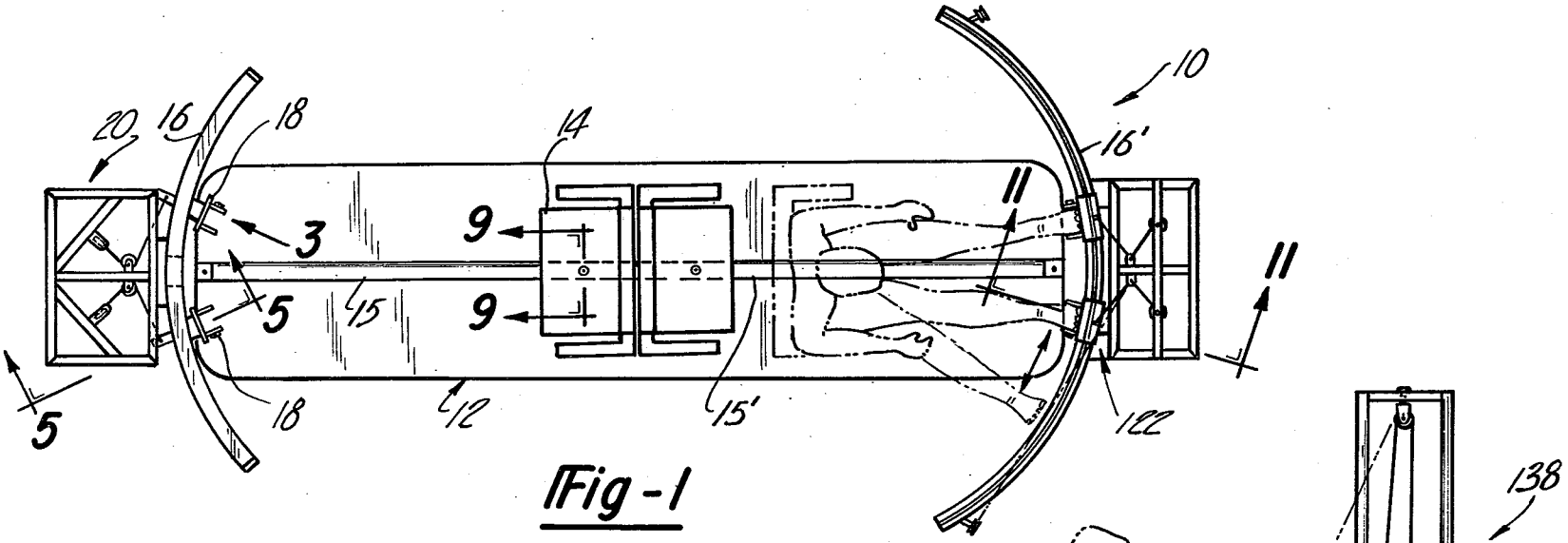
FIG. 1 is a top plan view of a device in accordance with the present invention.

Now, and with reference to the drawing, there is depicted therein an exercise and rehabilitative device in accordance with the present invention and, generally, denoted at 10. The device 10, generally, comprises: (a) a table 12, (b) a chair 14, (c) a first track 16, (d) a first foot-engaging boot 18 and (e) a system of weights 20 operatively connected to the boot. The chair 14 is horizontally translatable along a track 15 mounted on the table 12. The track 16 is disposed substantially perpendicular to the path of travel of the chair 14.

In a preferred embodiment of the present invention, the device hereof comprises a pair of opposed chairs 14 and 14'. Associated with each chair is a track 16 and 16', respectively. One track 16 is adapted for knee strengthening and the other track 16' is adapted for ankle strengthening. For purposes of facilitating an understanding of the present invention these designations will be maintained throughout the ensuing discussion.

Referring, again to the drawing, and with more specificity, the table 12 comprises an elongated top 22 and depending ground-engaging legs 24. The legs 24 extend between the top 22 and the ground and support the top.

Seated atop the table are the seats 14 and 14'. The seats are opposed to each other with their, respective, backs abutting when the two chairs are centrally located on the table. Each chair 14 or 14' is slidably mounted onto an elongated track 15, 15', respectively. Each seat accomodates a user for seating thereon. The track associated with the seat enables the seat or chair to be adjustably horizontally and/or vertically translated along the length thereof to adjust the positioning of the chair.

In FIGS. 9 and 10, there is depicted one possible means for achieving the adjustable horizontal translation of the chair 14 or 14'. The means, generally, indicated at 26 comprises a plate 28 which is secured to the bottom of the chair 14. The plate 28 has a central annular ring member 30 which fits within the channel 32 of the track 15. A pair of opposed wedges 34, 36 are urged into frictional engagement with the sides of the track 16 via means 38.

The means 38 comprises a rotatable shaft 40, which is threadedly disposed in a threaded bore 42 and which extends into an opening 44 provided between the wedge members 34, 36. The medial portion of the shaft has a larger diameter than that of the opening 44. Thus, as the shaft 40 is threadedly rotated through the bore and opening, the shaft urges the wedge members into engagement with the associated sidewalls of the track. Loosening of the shaft from the opening permits the chair to be slidably horizontally adjusted on the track. Rotation of the shaft is achieved through any suitable mode, such as a handle 46 integrally formed with the shaft.

Figure 2:
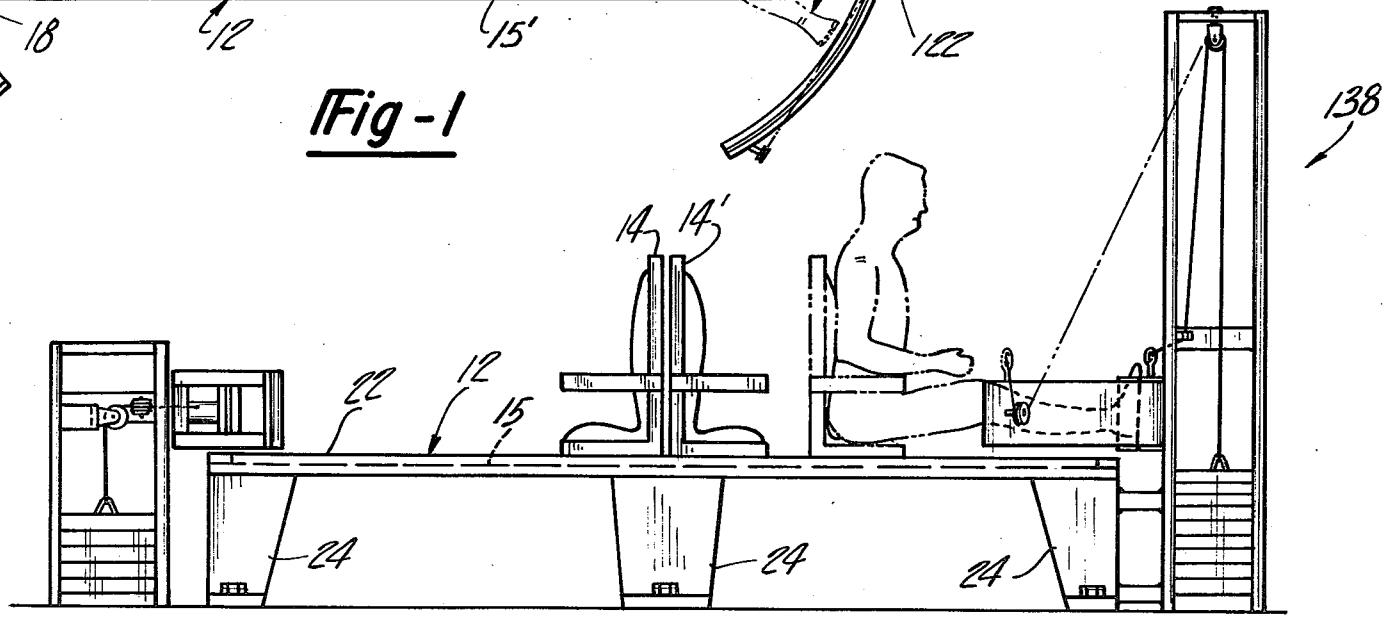
FIG. 2 is a side elevational view of the device hereof.

As noted hereinabove, the adjustability of the chair 14 enables utilization of the foot-engaging boot 18. The boot 18 is primarily designed for ankle exercise. In considering the boot 18 and the associated exercising media, it is to be understood that there is a boot 18 for each foot of the user. The structure of the boot 18 and its associated weight system 20 is more particularly depicted in FIGS. 3–8 with general situs depicted in FIGS. 1 and 2.

The boot 18 comprises a rear plate 48 against which the sole of the foot of the user abuts. A pair of opposed right angle plates 50, 52 each have one leg 54, 56 secured to the front of the plate with the other leg 58, 60 projecting at right angles therefrom toward the chair, as shown. The foot of the user disposed between the legs 58, 60.

Figure 3:
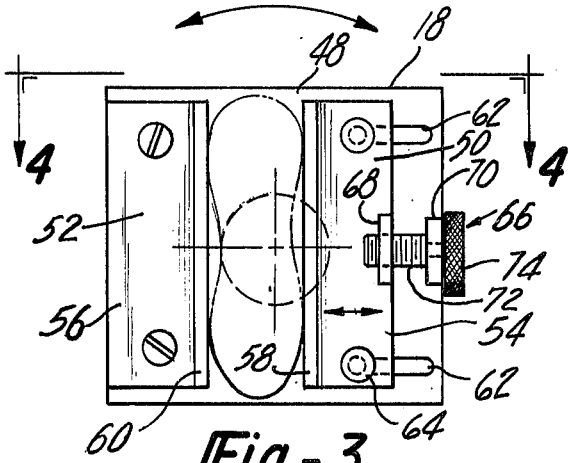
FIG. 3 is a front elevational view of a foot engaging boot as seen from the direction of the arrow 3 of FIG. 1.
Figure 4:
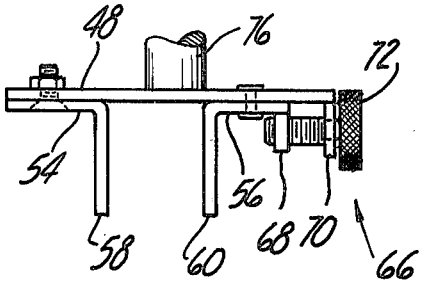
FIG. 4 is a sectional view taken along line 4—4 of FIG. 3.

As shown in FIG. 3, one of the plates 52 or 50 is horizontally translatable to render the width of the area adjustable to accomodate various foot sizes. The adjustability is accorded by the provision of a pair of vertically spaced apart slots 62 formed in the plate 48. A pair of threaded fasteners 64 extend through the associated plate 50 or 52 and into the slot 62. A threaded fastener or the like is secured to the end of the fastener and which threadedly abuts the rear of the plate 48 to lock the associated plate 52 or 50 in position.

The adjustable plate 52 or 50 is locked in position against vertical or horizontal movement through an auxillary locking mechanism generally denoted at 66. The auxillary locking mechanism comprises a stub plate 68, which is formed perpendicular to the leg 54 or 56 and which projects outwardly therefrom. The stub plate has a central aperture formed therethrough. The end of the plate 48 has a projecting right angle member 70 formed therewith which projects parallel to the stub plate 68, as shown. The member 70 has a central aperture formed therethrough which is in registery with the aperture formed in the stub plate 68. A threaded member is inserted through the apertures, which are, preferably, internally threaded. The threaded member 72 is then threadably inserted through the two members. A neuraled locking head 74 is integrally formed with the threaded fastener. Upon threaded rotation of the fastener 72, the neuraled locking head 74 abuts against the member 70 to securely lock the plate 50 or 52 in position.

Figure 5:
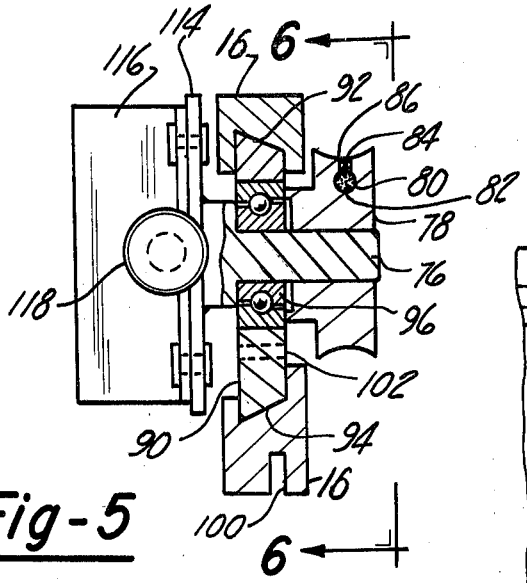
FIG. 5 is a cross-sectional view of a boot taken along line 5—5 of FIG. 1.
Figure 6:
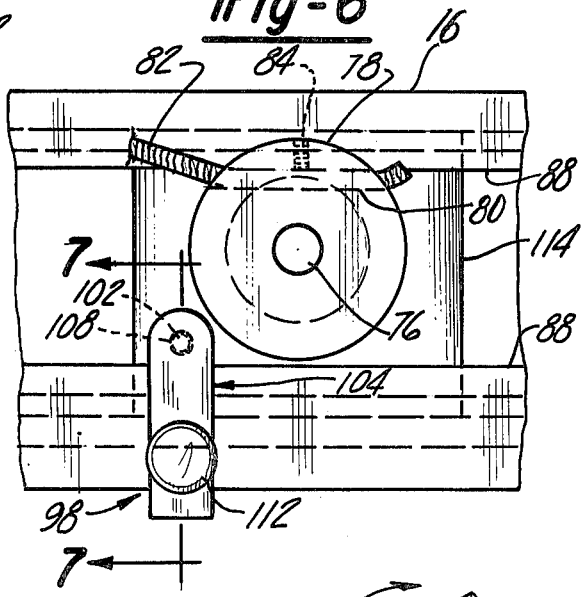
FIG. 6 is a sectional view taken along line 6—6 of FIG. 5.
Figure 7:
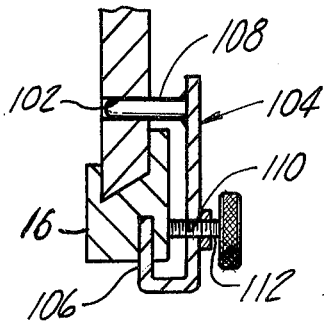
FIG. 7 is a cross-sectional view taken along line 7—7 of FIG. 6.
Figure 8:
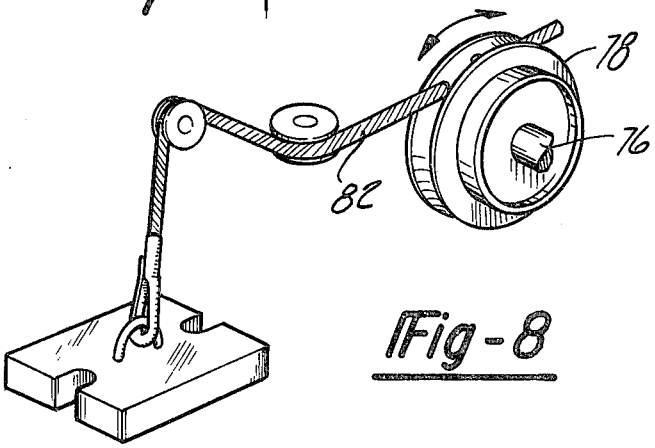
FIG. 8 is a perspective view of a weight and pulley assembly utilized in the practice hereof.

As pointed out hereinbefore, one of the major advantages of the present invention is its ability to provide not only lateral exercise but rotary exercise to the knee and ankle. The boot hereof is interconnected to the system of weights in such a manner as to enable both lateral and rotary motion thereof. In order to accomplish same, the boot 18 is slidably mounted onto track 16. The track 16 is an arcuate member which extends beyond the lateral sides of the table 12. The track is configured in an arcuate mode to accommodate the normal lateral motion of the leg which is an arc, rather than a linear movement. In FIGS. 5–7, a detail of the mounting of the boot 18 onto the track is depicted.

The plate 48 is rotatably mounted onto a shaft 76, which projects rearwardly laterally therefrom. The shaft 76 has a cable wheel 78 journalled thereon. The cable wheel 78 has a peripheral throughbore 80 formed therethrough through which extends a cable 82 which is connected to the system of weights 20 in a manner to be described subsequently. The wheel 78 is integrally formed with the shaft 76 and is rotatable therewith. A set screw 84 is disposed in a radial threaded bore 86 formed in a groove of the wheel 78 and is utilized to lock the cable in position, as shown. The wheel 78 is rotatable in the track 16 in response to the lateral movement of the boot 18. The groove formed in the wheel rides in complementary projections 88 formed in the track to facilitate the rotation. Thus, the lateral movement of the boot along the arcuate track is effectuated by the user laterally moving his foot, which is disposed within the boot. Because of the interconnection between the wheel 78 and the system of weights 20, sufficient retardation of motion is provided to accomplish the goals and purposes of conditioning in accordance with the present invention. However, and as noted, the boot 18 is rotatable about the horizontal axis with the boot locked in position to impart the necessary rotary conditioning. To this end, the shaft 76 is mounted onto a dovetail housing 90 disposed rearwardly of the wheel 78. The dovetail housing is disposed in complementary upper and lower grooves 92, 94, respectively, formed in the track 16. A bushing 96 envelopes the shaft 76 and is disposed within the housing 90 to facilitate rotation of the shaft 76. The grooves 92, 94 formed in the track 16 are configured in a dovetail or chamfered configuration to avoid dislodgement of the housing 90 from the track. Because the shaft 76 is interconnected to the housing 90, as the boot 18 is laterally translated, the housing slides within the grooves 92, 94.

In order to be totally effective in accomplishing the purposes to which the present invention is directed, it is necessary to be able to lock the boot 18 in any position along the path of travel thereof. To this end, there is provided means, generally denoted at 98 for accomplishing this purpose. As detailed in FIGS. 5–7, the lower end of the track 16 is provided with a groove 100. The housing has a throughbore 102 formed therethrough. A J-shaped plate member 104 has its short leg 106 adapted to seat within the groove 100. A projecting perpendicular pin 108 integrally formed with the elongate leg of the J-shaped member projects into the bore 102. A lower aperture 110 is formed in the elongate leg and has a lock nut 112 projecting therethrough. By tensioning the lock nut against the lower end of the track, the housing 90 is locked within the track at any fixed location. By loosening the lock nut, lateral translation of the housing and, therefore, the boot is accomplished. When locked in position, only rotary movement of the boot is capable of being effectuated to thereby provide the necessary conditioning exercise.

The terminal end of the shaft 76 is fixedly secured onto a plate 114 which is interconnected to a support housing 116. The support housing 116 carries a pulley 118 over which the cable 82 travels. From the housing, the cable travels to the set or system of weights 20 via a pulley system which is of known construction. With respect hereto, it is to be noted that the system of weights 20 can have its associated cable 82 positioned as desired. For example, the cable can be attached at either the medial or terminal end of the track, as desired. This provides resistance when moving the leg either laterally outwardly or laterally inwardly, depending on the starting point. This is achieved by threading the cable, as desired, onto the wheel 78.

Also, and with respect hereto, it is to be contemplated by the practice of the present invention that the housing 116 can have disposed therewithin suitable electrical means for electrically moving the boot within the track. Alternatively, other motive forces, such as pneumatic or hydraulic means can be utilized to move the boot within the track. Such means are advantageous when attempting to recondition an injured ankle which cannot ordinarily accomplish movement of the boot through manual forces.

It is to be appreciated from the preceding that there has been described a conditioning and exercise device for facilitating strengthening of the ankle.

Now, and with particular attention being directed to FIGS. 1, 2, 11 and 12 there is depicted therein a knee exercising assembly in accordance with the present invention.

It is to be noted with respect hereto that this portion of the present invention has associated therewith the track 16', the chair 14', as well as the necessary means for horizontally translating the chair within the track and which is similar to the system heretofore described with reference to FIGS. 9 and 10.

The knee exercising portion of the present invention further comprises an arcuate track 16' which has its lateral ends extending beyond the width of the table 12, as shown. In utilizing the knee portion of the present invention, the foot of the user is disposed within a boot generally denoted at 122. The boot 122 is constructed similarily to the boot 18 heretofore described. However, the boot 122 further comprises a lower plate 124 which traverses the span or area between the projecting legs of plates 126 and 128. The plates 126, 128 are secured to a rear plate 130 which is rotatably mounted onto a support member 132. It is the support member 132 which engages the track 16'. It is to be noted in this regard that the boot 122 has the width between the plates 126 and 128 adjustable in the same manner heretofore defined. Also, the boot is structured to be locked in any position along the arcuate path of travel within the track through the same J-shaped groove in projecting pin assembly or similar mode heretofore described. Also, it should be noted with respect hereto that the boot 122 is mounted on a bearing or similar member 134 which provides a bearing surface between the boot and the track to facilitate the lateral movement of the boot along the arcuate path of travel. An eye hook 136 is secured to the top of the boot support assembly and which is interconnected to a conventional weight system, generally, denoted at 138. The weight system includes the requisite pulleys and weights and cables which are interconnected to effectuate a resistance to lateral movement of the boot within the track. Again, the weight system is changeable whereby the resistance afforded the weights can be directed from the terminal end of the track towards the medial portion or from the medial portion towards the terminal end, depending on the direction of lateral movement of the leg of the user. Furthermore, the boot may be rendered universally rotatably in any position along the track 16'. This is achieved by providing a substantial distance between the rear plate 130 and the support member 132 to permit rotation of the plate 130 and, thus, the boot. A ball and socket system deployed between the plate 130 and the support member 132 to permit universal rotation. This is achieved, for example, by an elongated shaft extending between the plate and the support and having a ball mounted onto the plate engaging end thereof. A socket is disposed on the rear of the plate 130 and rotatably engages the ball, in the known manner. Similarly, such a mounting can be effectuated with respect to the boot 18.

It is to be appreciated from the preceding that there has been described herein an exercise in reconditioning device which enables not only the lateral movement of the limb but, also, rotary movement of the limb against a weight resistance. By affording such, there is provided not only conditioning but strengthening of the tenons and other tissue which envelope the joints which are most susceptible to injury.

Having, thus, described the invention what is claimed is:

1. An exercise and conditioning unit, comprising:
(a) a table,
(b) a horizontally translatable chair mounted on the table,
(c) an elongated track associated with the table and being disposed substantially perpendicular to the path of travel of the chair,
(d) a foot-engaging boot mounted onto the track and being laterally moveable therealong,
(e) means for facilitating rotation of the boot, and
(f) a system of weights interconnected to the boot.

2. The unit of claim 1 which further comprises:
means for locking the boot in position along the track.

3. The unit of claim 1 which further comprises:
means for moving the boot along the path of travel of the track.

4. The unit of claim 1 wherein:
the track has an arcuate configuration.

5. The unit of claim 1 which further comprises:
(a) a pair of opposed oppositely horizontally translatable chairs mounted on the table:
(b) an elongated track arcuate track associated with each end of the table, each track being disposed substantially perpendicular to the path of travel of the associated chair,
(c) a pair of foot-engaging boot mounted onto each track and being moveable therealong,
(d) means for faciliating rotation of each boot by rotational movement of a foot disposed in the boot, and
(e) a system of weights interconnected to each boot.

6. The unit of claim 1 wherein the foot engaging boot comprises:
(a) a rear plate,
(b) a first right angle plate fixedly secured to the rear plate,
(c) a second right angle plate spaced apart from the first plate and being adjustably mounted onto the rear plate to vary the distance between the first and second right angle plates, and
(d) means for adjusting the distance between the first and second right angle plates.

7. An exercising assembly, comprising:
(a) a table, (b) an elongated track positioned on the table and disposed substantially perpendicular thereto, (c) a boot adapted to be received by a user mounted onto the track and being moveable by a user along the extent thereof, and (d) means for facilitating rotation of the boot with respect to the track upon the application of a rotational force by a user.

8. The assembly of claim 7 which further comprises: means for locking the boot in a position along the extent of the track.

9. The assembly of claim 7 which further comprises: a system of weights interconnected to the boot.

10. The assembly of claim 7 wherein the boot comprises:

(a) a rear plate, (b) a first right angle plate fixedly secured to the rear plate, (c) a second right angle plate spaced apart from the first plate and being adjustably mounted onto the rear plate to vary the distance between the first and second right angle plates, and (d) means for adjusting the distance between the first and second right angle plates.

11. The assembly of claim 10 wherein the means for facilitating rotation comprises:

(a) a U-shaped support plate, the bight portion of which is coincident with the rear plate, the legs of the support plate engaging the track;

(b) a rotatable shaft extending between the rear plate and the bight portion of the support plate, and wherein the rear plate is rotatable about the shaft.

12. The assembly of claim 10 wherein the means for facilitating rotation comprises:

(a) a shaft extending laterally outwardly from the rear plate, (b) a bifurcated housing journalled onto the shaft at the other end of the shaft, (c) a bushing journalled onto the shaft and disposed in the housing, the bushing enveloping the shaft, the shaft being rotatable therearound, and (d) the periphery of the housing being disposed within a groove in the track and moveable therewithin.

* * * * *